United States Patent [19]

Beistegui Chirapozu

[11] Patent Number: 4,479,646

[45] Date of Patent: Oct. 30, 1984

[54] GYMNASTIC BICYCLE

[75] Inventor: Jose L. Beistegui Chirapozu, Vitoria, Spain

[73] Assignee: B.N., S.A., Madrid, Spain

[21] Appl. No.: 404,892

[22] Filed: Aug. 3, 1982

[30] Foreign Application Priority Data

| | | | |
|---|---|---|---|
| Aug. 5, 1981 | [ES] | Spain | 259.882[U] |
| Aug. 5, 1981 | [ES] | Spain | 259.883[U] |
| Aug. 5, 1981 | [ES] | Spain | 259.884[U] |
| Aug. 5, 1981 | [ES] | Spain | 259.885[U] |

[51] Int. Cl.[3] ..... A63B 23/02; A63B 69/06

[52] U.S. Cl. ..... 272/73; 128/25 R; 272/72; 272/DIG. 4

[58] Field of Search ..... 272/73, 72, DIG. 4; 128/25 R, 32, 33, 62 R, 63, 64

[56] References Cited

U.S. PATENT DOCUMENTS

| | | | |
|---|---|---|---|
| 2,259,551 | 10/1941 | Burke | 128/25 R |
| 2,320,489 | 6/1943 | Turner et al. | 128/25 R |
| 2,419,998 | 5/1947 | Johnson | 272/72 X |
| 2,790,439 | 4/1957 | Mayers | 272/73 X |
| 3,024,023 | 3/1962 | Steller | 272/73 |
| 3,899,115 | 8/1975 | Simjian | 128/63 X |
| 3,945,637 | 3/1976 | Simjian | 128/25 X |
| 3,960,144 | 6/1976 | Simjian | 128/63 X |

FOREIGN PATENT DOCUMENTS

| | | | |
|---|---|---|---|
| 976576 | 10/1975 | Canada | 272/73 |
| 1062738 | 9/1979 | Canada | 272/73 |
| 2333340 | 1/1975 | Fed. Rep. of Germany | 272/73 |
| 615245 | 10/1926 | France | 272/72 |

*Primary Examiner*—Robert A. Hafer
*Assistant Examiner*—Arnold W. Kramer
*Attorney, Agent, or Firm*—Wenderoth, Lind & Ponack

[57] ABSTRACT

A gymnastic bicycle includes a frame mountable on the floor and having at a forward portion a tubular part or stem which supports a handlebar and at a rear portion a tubular part supporting a seat and provided with a pedal shaft operable by pedals. Incorporated in an articulation zone between the lower end of the tubular piece or stem supporting the handlebar and the frame of the bicycle is a friction device having an adjustable resistance which permits the physical force of the user to be adjusted when he practices an exercise corresponding to rowing, such exercise taking place by the forward and backward oscillation of the handlebar. At such articulation zone is a main vibrating mechanism whose main operating element is a polygonal member securely mounted on the pedal shaft so that the vibrations produced as a result of the operation of the main vibrating mechanism are transmitted to the handlebar of the bicycle. Additional devices transmit the vibrations independently to the abdominal region and to the lumbar region of the user.

12 Claims, 7 Drawing Figures

A – B

GYMNASTIC BICYCLE

BACKGROUND AND SUMMARY OF THE INVENTION

The present invention relates to a gymnastic bicycle which is designed so that the user can practice different physical exercises.

One of the objects of the invention is to provide the gymnastic bicycle with a vibrating mechanism, the main element of which comprises a polygonal shaped member mounted on the pedal shaft of the bicycle, whereby the vibration produced by such member is transmitted through suitable means to the handlebar of the bicycle.

Another object of the invention is to provide the gymnastic bicycle with a friction device having an adjustable resistance, the purpose of which is to adjust the physical force required by the user during those type of exercises which resemble rowing, which takes place by using the handlebar itself of the bicycle.

A further object of the invention is to provide the bicycle with a device which, joined to the main vibrating mechanism, permits the vibrations produced when pedalling to be transmitted to the abdomen of the user.

A final object of the invention is to provide the bicycle with another device, also joined to the main vibrating mechanism, whereby the vibrations are transmitted to the lumbar region of the user.

Therefore, with the gymnastic bicycle of the invention the user can practice physical exercise resembling rowing and which will be carried out by using the handlebar itself of the bicycle, while if the user practices the physical exercise of pedalling, vibrations will be produced and will be transmitted, through the handlebar itself and the previously mentioned devices joined to the main vibrating mechanism, to the abdomen and lumbar region of the user.

The friction device having an adjustable resistance, the purpose of which is to adjust the physical force to be employed by the user during exercises resembling rowing which are carried out by using the handlebar, is so designed that the device itself permits the handlebar to be oscillated about a transverse axis, the oscillation of the handlebar produced by the user with his own effort.

The resistance to such oscillation is adjustable depending on the amount of force or the degree of preparation which the user desires to apply in his exercises. The device basically includes an axle joined to the lower end of the tubular piece or stem which supports the handlebar, which axle is disposed transversely and is capable of oscillating about its own axis. The complete assembly of the handlebar is capable of producing displacements in the longitudinal direction of the frame of the bicycle due to the articulated mounting of the axle. The inner walls of the axle are formed to have truncated sections forming sliding and friction surfaces for corresponding sleeves or truncated pieces which fit therein. Tightening means are joined to the general chassis of the bicycle and form elements for achieving a greater or lesser resistance to the rotation of the axle and, consequently, to the oscillating movements of the handlebar to resemble the gymnastic exercises of rowing.

Therefore, the friction device having an adjustable resistance has a simple construction, can readily be mechanized and provides an optimum functioning, effectiveness and accuracy with regard to the purposes for which it is designed.

The main vibrating mechanism includes a thick projection extending radially backwardly from the axle of the friction device. This projection is provided with a transverse hole to receive a pin acting as a freely rotating shaft for a connecting rod which, at its opposite end, is joined by means of a transverse pin to a roller which is slidable along outer surfaces of the polygonal member forming the main element of the vibrating mechanism. The connecting rod is hinged to the projection of the axle at a lateral zone of the end of the connecting rod. Opposite to such zone the end of the connecting rod expands into a large concave curved surface the radius of curvature of which coincides with that of the outer surface of the axle, against which surface it bears in an operative position.

The roller is in permanent contact with the outer surfaces of the polygonal member due to the traction of a spring which joins the connecting rod to the frame of the bicycle. Thus, when the pedal shaft is rotated by the pedals, the polygonal member will rotate. Since the roller is permanently in contact with the polygonal member, vibrating movements will be imparted to the handlebar itself, and such movements will be transmitted to the body of the user and more specifically on the abdomen of the user.

In the event that the vibrating mechanism is to be rendered inoperative, so that the bicycle can perform other functions, there is disposed on the projection a screw provided with a driving head, which screw is mounted on the frame of the bicycle. Thus, when such screw is moved axially, the end thereof will push the projection, whereby the axle will make a partial turn. This pushing or oscillation of the projection moves therewith the articulation pin of the connecting rod such that the curved concave surface of the connecting rod moves away from the surface of the axle. Thus, the transmission of vibration is interrupted.

The polygonal member joined to the pedal shaft and along which the roller of the connecting rod slides is formed by deformation of a sprocket wheel, to form therein a prismatic-polygonal recess.

The device joined to the main vibrating mechanism and which permits the transmission of vibration towards the abdomen of the user hereinafter will be referred to as the abdominal vibrating device. Such abdominal vibrating device includes a bar having one end connected to the central zone of the handlebar. The opposite end of the bar prolongs into a fork between the free ends of which is retained a flexible transverse band which may be adapted to the abdominal region of the user. This device permits the vibrations produced in the main vibrating mechanism to be transmitted to the abdominal region of the user. The abdominal vibration mechanism furthermore has the important advantage that it can adopt different lengths since the bar which is connected to the central zone of the handlebar is formed of two telescopically connected tubes.

The device likewise joined to the main vibrating mechanism and which permits the vibrations originated by the main vibrating mechanism to be transmitted to the lumbar region of the user, hereinafter will be referred to as the lumbar vibrating device. Such lumbar vibrating device includes a band made of a flexible fabric material which is designed to clasp the lumbar region of the user. This band is subjected to a rate of vibrations which is determined by the user himself, depending on the pace at which he pedals. The band of fabric material is mounted between the arms of a Y-shaped fork having a telescopic vertical shaft, a lower arm of which is slightly bent and the lower end of which is positioned adjacent the polygonal member secured to the pedal shaft. At such lower end is rotatably mounted a roller which is in contact with the polygonal member. During rotation of the member, the roller will be subjected to a series of blows which will be transmitted, through the fork, to the band of fabric material. This transmission of blows will take place in the form of mechanical vibrations which will impart to the user a highly therapeutic massage.

BRIEF DESCRIPTION OF THE DRAWINGS

To complement the following detailed description and for a better understanding of the characteristics of the invention, reference is made to the accompanying drawings wherein.

DETAILED DESCRIPTION OF THE INVENTION

Figure 1:
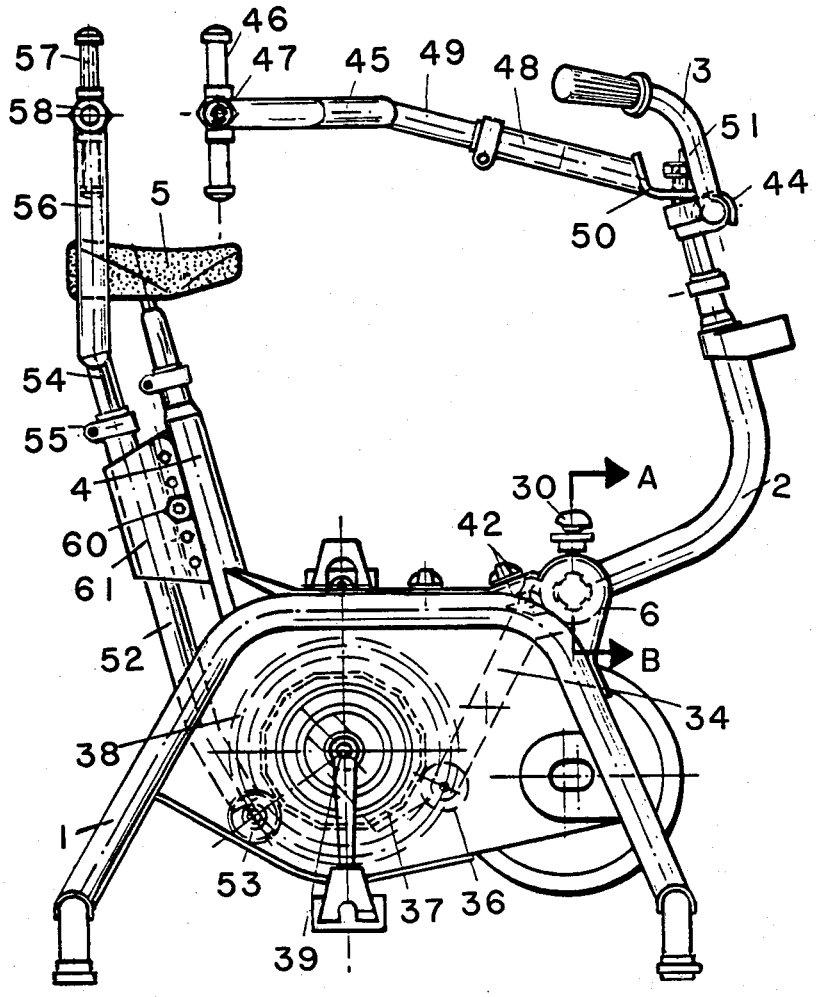
FIG. 1 is a side elevational view of a gymnastic bicycle according to the invention.

Referring to the drawings, it will be seen the gymnastic bicycle of the invention includes a frame 1 formed by a chassis, a forward tubular piece or stem 2 which supports a handlebar 3 and a rear tubular piece or stem 4 on which is telescopically fixed a seat 5.

A friction device having an adjustable resistance is formed by a transversely disposed axle 6 joined to the lower end of the tubular piece or stem 2 which constitutes the support of the handlebar 3. Axle 6 forms internally two end truncated sections 7 and 8 which define friction sliding surfaces for truncated bodies 9 and 10, respectively, which have lateral walls continuously in close contact with sections 7 and 8.

Figure 3:
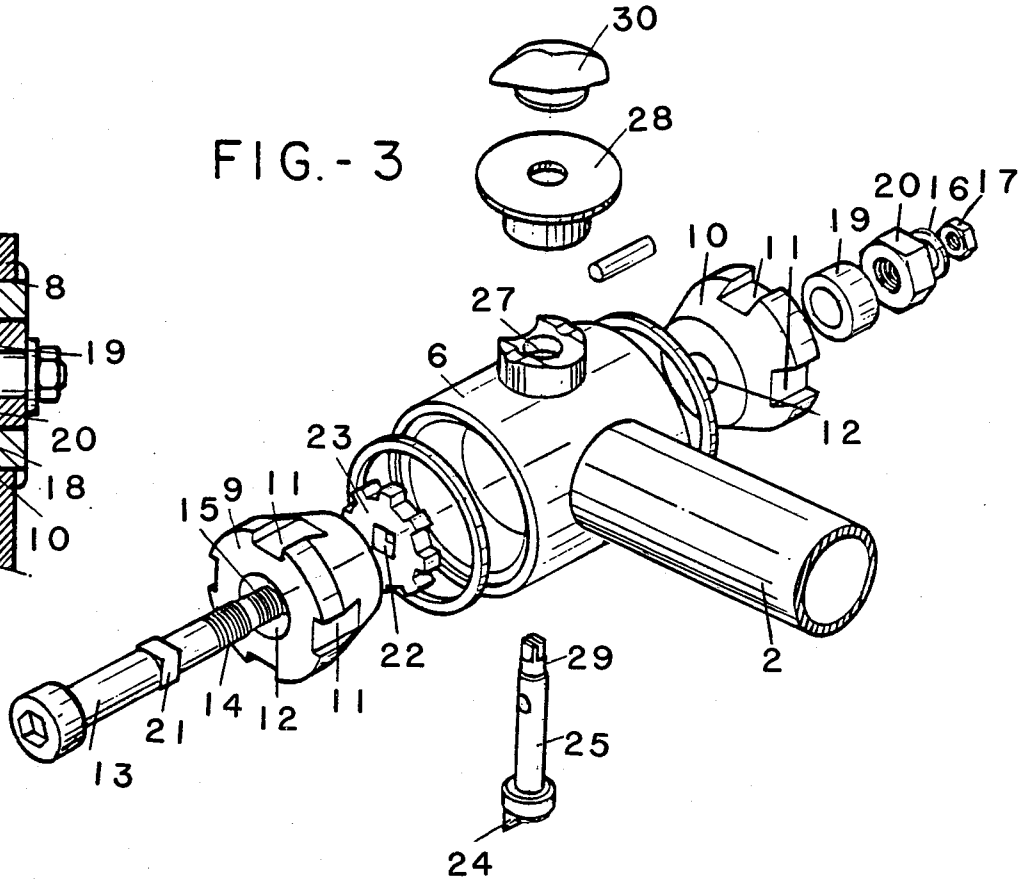
FIG. 3 is an exploded perspective view of the parts, shown in positions to be coupled together, which constitute the device of FIG. 2.
Figure 2:
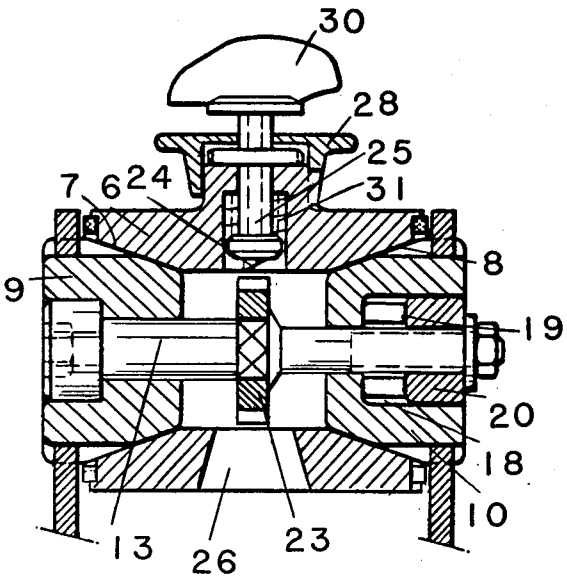
FIG. 2 is an enlarged cross-sectional view along line A-B of FIG. 1 of a friction device having an adjustable ressitance.

The truncated bodies 9 and 10 are provided around the peripheries thereof with a series of grooves 11 which fit tongues of respective plates which extend parallel to the major bases of the truncated bodies 9 and 10, which plates are fixed to the chassis constituting the frame 1 of the bicycle itself. Such plates thus prevent rotation of bodies 9 and 10 relative to axle 6. Likewise, the truncated bodies 9 and 10 each have an axial hole 12 through which passes a screw or bolt 13 having, close to one of its ends, two threaded sections 14 and 15 which are differentiated and separated from one another. Screw 13, which can turn freely in the inside of the holes 12, is introduced through the truncated body 9, so that the threaded section 15 emerges through the truncated body 10 and receives a washer 16 and a nut 17 which joins and connects the assembly of the pieces clearly illustrated in FIG. 3 and which, in an operative position, adopts the configuration illustrated in FIG. 2.

The truncated body 10 has, extending inwardly from its major base, a recess 18 to receive a small sleeve 19 and a nut 20 which is threaded onto section 14. The contour of recess 18 is exactly identical to that of the nut 20 so that nut 20 can be retained in the notch 18 and prevented from turning upon rotation of screw 13.

The screw 13 has, at approximately the middle of its length, a section 21 having a quadrangular contour which is housed in a quadrangular hole 22 provided in a pinion 23 which occupies the middle zone of the interior of axle 6. Pinion 23 constitutes a tightening means by which the user selects the degree of resistance of the friction mechanism having an adjustable resistance which is being described and which is clearly illustrated in FIGS. 2 and 3 as previously mentioned.

To select the degree of resistance, there is a pawl 24 by means of which pinion 23 can be activated selectively to rotate screw 13 in a desired direction. Pawl 24 is part of a ratchet 25 which, previously inserted through a hole 26 in the lower zone of the axle 6, protrudes through a diametrically opposed projection 27, passes through an intermediate piece 28, and is locked by a notch 29 to an outer control 30 which is employed by the user to adjust the resistance of the device or mechanism. The ratchet 25 is permanently subjected to the action of a spring 31 incorporated in the axle 6 itself.

From the above description, it will be understood that the greater the pressure exerted by the truncated bodies 9 and 10 against the respective sections 7 and 8, the greater will be the difficulty encountered in attempting to rotate the axle 6 relative to bodies 9 and 10 and, consequently, the tubular portion or stem 2 and the handlebar 3 so that it can oscillate. The pressure of truncated bodies 9 and 10 against respective sections 7 and 8 is determined by the degree of threading of the nut 20 onto the screw 13. Thus, the bodies 9 and 10, as a result of increasing this threading, will tend to approach each other, thereby increasing the pressure against their respective sections 7 and 8.

The control 30 is capable of occupying different positions, thereby determining different positions for the pawl 24 with respect to the teeth of the pinion 23. In one of these positions the pawl 24, due to the action conferred thereto by the spring 31, will be fixed between two consecutive teeth of the pinion 23, and will cause the pinion to rotate provided that the handlebar 3 moves in a determined direction, for example, in a direction toward the seat 5 of the bicycle. However, upon movement in the opposite direction, i.e. in which the handlebar 3 is separated from the seat 5, the pinion 23 will not turn since the pawl 24 has a ratchet-like edge which will avoid the teeth of the pinion.

In another position of the control 30, the pawl will be locked in a manner opposite to that previously described, and during such locking the pinion 23 will be caused to rotate when the handlebar 3 is moved in the direction away from the seat and will not rotate when the handlebar is moved toward the seat.

Finally, when the control 30 occupies a third position, the pawl 24 is in a coplanar position with respect to the pinion 23, so that the edge of the pawl 24 is perpendicular to the teeth of the pinion 23 and thereby slides thereon without producing any action on pinion 23 in either of the directions of movement of handlebar 3.

Due to these movements of the pinion 23, produced by the position adopted by the control 30, the user can select the degree of resistance to the movement of the handlebar 3. Since rotation of the pinion 23 necessarily results in rotation of the screw 13 and, consequently, the tightening or loosening of the screw with respect to the nut 20, the truncated bodies 9 and 10 will be moved more tightly or less tightly, respectively, against respective sections 7 and 8, thus obtaining different degrees of tightening and, therefore, resistance. Once the control 30 is suitably activated by the user such that the desired degree of resistance of the device has been selected, the user will place the control 30 in the position thereof at which the pawl 24 will be inoperative. The user then can start his exercises.

Figure 4:
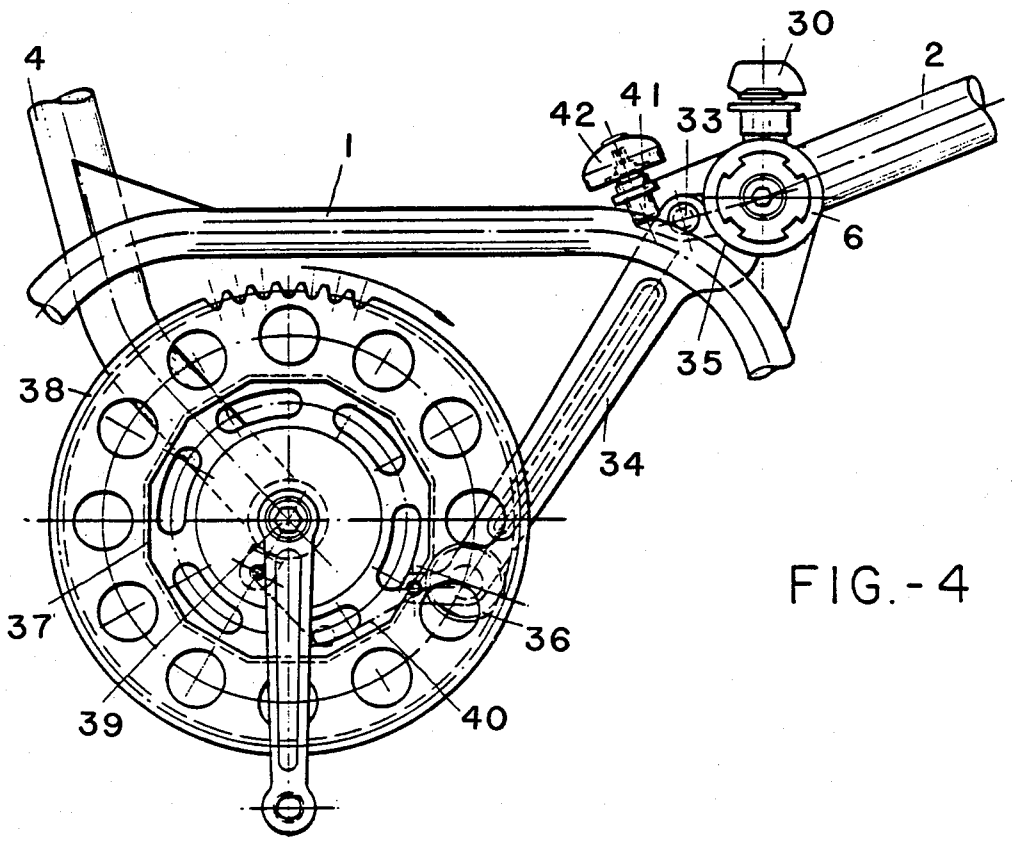
FIG. 4 is a side view of that portion of the bicycle whereat a main vibrating mechanism is mounted.
Figure 5:
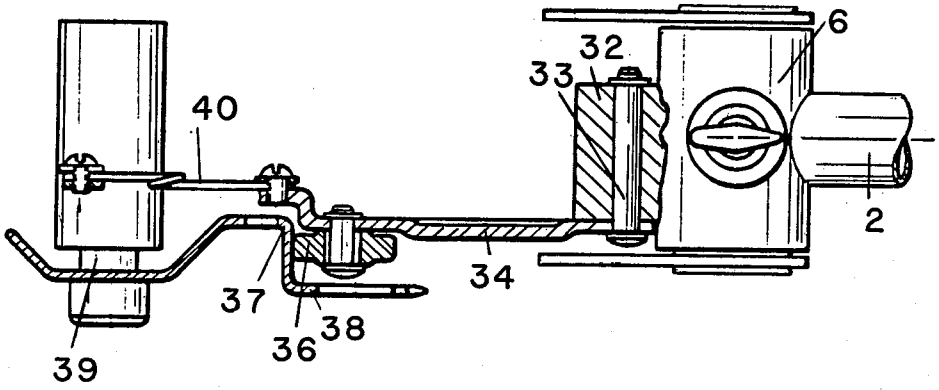
FIG. 5 is a partial sectional view of the mechanism of FIG. 4.

The main vibrating mechanism illustrated in FIGS. 4 and 5 includes, extending radially rearwardly from the axle 6, an appendix or extension 32 provided with a transversal hole in which is housed a pin 33 acting as a freely rotating shaft for a connecting rod 34 which is hinged to pin 33 at a lateral zone corresponding to the upper end thereof, as clearly illustrated in FIG. 4. The upper end of connecting rod 34, opposite to the zone of connection thereof to the pin 33, has a large concave curved surface 35 the radius of curvature of which is equal to that of the outer surface of the axle 6, such that surface 35 can be brought into contact with the outer surface of axle 6.

The lower end of the connecting rod 34 is joined to a roller 36 which slides on the outer surfaces of a polygonal member 37 forming the main element of the vibrating mechanism. Polygonal member 37 is a portion of sprocket wheel 38 and results from the deformation thereof to form a prismatic-polygonal recess therein. The sprocket wheel 38 and consequently the polygonal member 37 are joined to a pedal shaft 39 and rotate therewith, thus forming a source of vibration. The roller 36 is maintained in permanent contact with the polygonal member 37 due to the traction of a spring 40 which joins the connecting rod 34 to the general frame of the bicycle.

Thus, when the pedal shaft 39 is rotated by the activation of its corresponding pedals, the polygonal member 37 will turn. Therefore, due to the permanent contact of the roller 36 with the outer surfaces of polygonal member 37 and due likewise to the rotation of member 37, there will be produced a movement of the connecting rod 34 which will be vibrating and which will be transmitted to the axle 6 itself. Such vibrating movement likewise will be transmitted to the handlebar 3, which vibrations reach the user and will be concentrated in the abdominal region of the body of the user.

The vibrating mechanism thus constructed can be made inoperative so that the bicycle can be used for another purpose, such as that of rowing which is carried out by the already described friction device having an adjustable resistance. For rendering the vibrating device inoperative, there is provided on the appendix 32 a screw 41 having a corresponding drive control 42 and mounted on the general frame of the bicycle at a position close to the control 30. Axial movement of screw 41 will produce a pushing force on the appendix 32 and, consequently, a pushing force on the pin 33. As a result, the concave surface 35 no longer will be in contact with the outer surface of axle 6, and the transmission of vibrations therebetween is interrupted.

Figure 6:
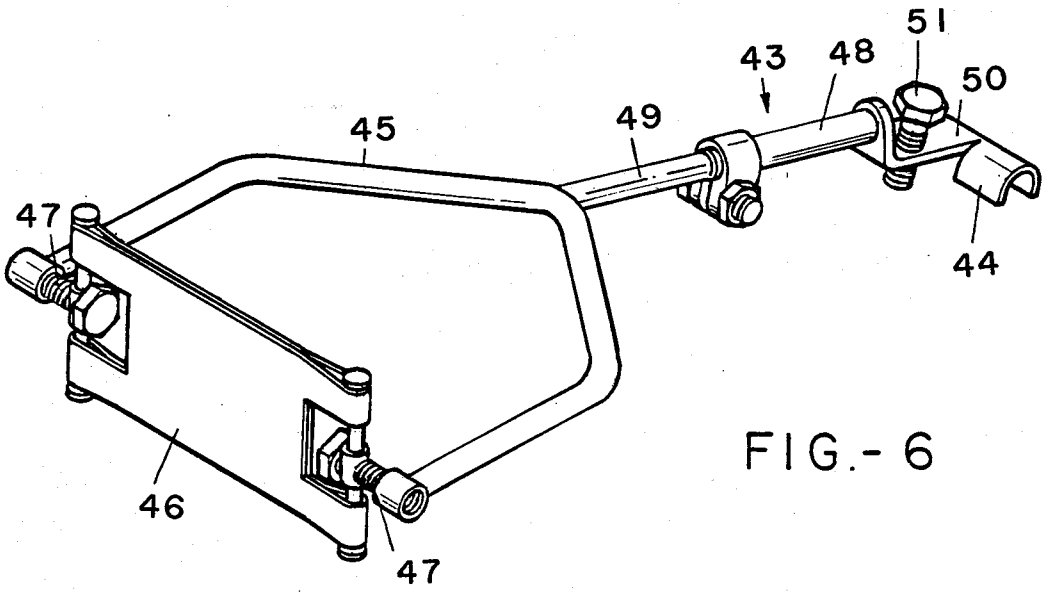
FIG. 6 is a perspective view of an abdominal vibrating device.

The abdominal vibrating device illustrated in FIG. 6 is joined to the main vibrating mechanism, i.e. the operation of the abdominal vibrating device is conditioned on operation of the main vibrating mechanism. The abdominal vibrating device includes a transmission rod 43, to one end of which is incorporated a semi-clamp 44 to be coupled to the central zone of the handlebar 3. The opposite end of transmission rod 43 prolongs into a fork 45. Between the ends of the arms of fork 45 is fixed a transverse elastic band 46 to be adapted to the abdominal region of the user. Fixing of the elastic band 46 to the ends of the corresponding arms of the fork 45 is achieved by tightening elements 47. The transmission rod 43 is formed of two telescopically coupled tubes 48 and 49 which permit the fork 45 to be separated, when desired, from the handlebar 3. The semi-clamp 44 prolongs into a short flat section 50 provided with a threaded hole receiving a screw 51 which rests on the upper end of the tubular piece or stem 2 supporting the handlebar. This permits the degree of inclination of the transmission bar 43 and therefore of the complete assembly of the abdominal vibrating device to be adjusted at will by rotation of screw 51.

With this structure there is obtained a device which permits the vibrations to be transmitted to the abdominal region of the user. Also, the length of the device can be adapted to the user, since the transmission rod 43 is formed of the telescopic tubes 48 and 49. Likewise, it is possible to adjust the inclination of the complete assembly by actuating the screw 51 to be able to select the accurate angle of inclination between the transmission rod 43 and the support of the handlebar 3. The tension of the elastic band 46 also can be adjusted by activating the tightening elements 47 which are disposed on the ends of the arms of the fork 45. Thus, when the main vibrating mechanism operates, due to the turn of the polygonal member 37, the vibrations of such mechanism are transmitted to the handlebar 3, and therefrom to the elastic band 46 which is adapted to the abdominal region of the user.

Figure 7:
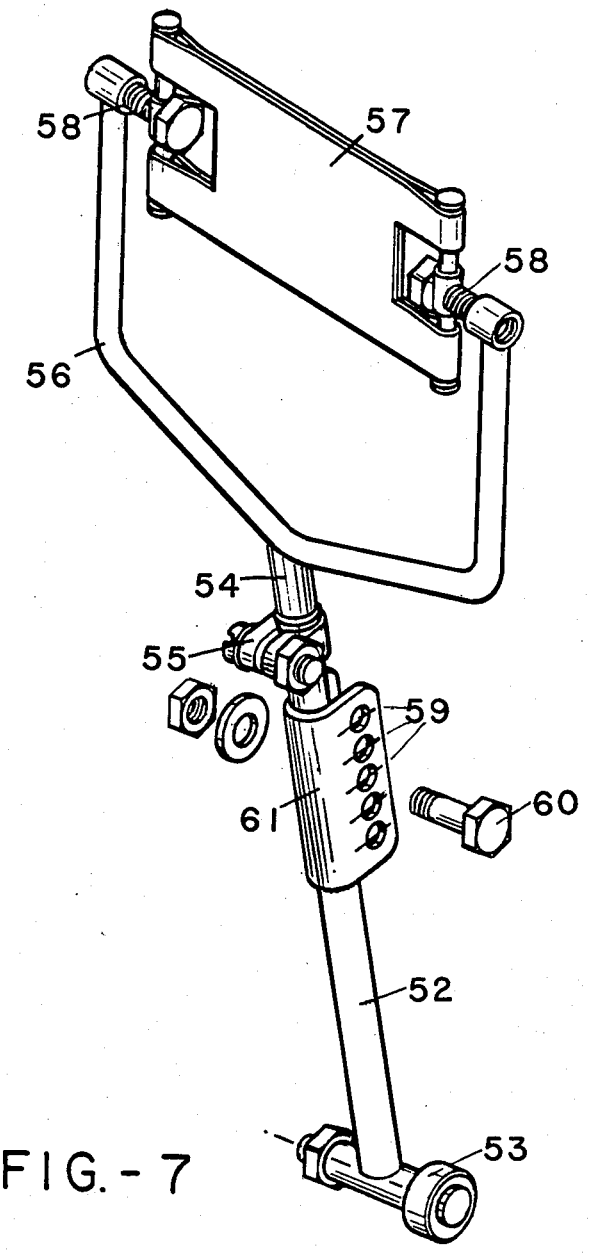
FIG. 7 is a perspective view of a lumbar vibrating device.

Finally, there will be described the lumber vibrating device which is illustrated in FIG. 7 and the functioning of which, as in the case of the abdominal vibrating device, is due to the vibrations produced by the main vibrating mechanism which is obtained by rotation of the polygonal member 37.

The lumber vibrating device includes an arm or lever 52 which is hinged at its center to the tubular piece 4 supporting the seat 5. The lower end of arm or lever 52 supports a roller 53 which is positioned on the periphery of the polygonal member. Thus, during rotation of member 37, thereof, and consequently the vertices thereof, will rest on the corresponding periphery of the roller 53, thereby imparting a continuous source of vibration to the arm or lever 52. Arm 52 has projecting from the upper end thereof a telescopically coupled leg 54. Fixing of the relative position between leg 54 to arm 52 is achieved by adjusting a clamp 55. The upper end of leg 54 prolongs into a fork 56. Between the ends of the arms of fork 56 is fixed a transverse elastic band 57 provided with tightening elements 58 joined to the ends of each one of the arms of the fork 56. The elastic band 57 is positioned precisely at the rear of the seat 5, so that band 57 adapts to the lumber region of the user.

To facilitate adjustment of band 57 to the lumbar region of the user, there is provided a U-shaped piece 61 fixed to the tubular piece 4 bearing the seat 5. Piece 61 has a plurality of holes 59 extending through both legs of the piece and constituting passageways for a fixing element 60 in the form of a screw, by means of which adjustment of the height and the angle of the complete lumbar vibrating device may be achieved. Thus, depending on the holes 59 selected for the passageway of the fixing screw 60, there will be obtained different variations of the point of connection of the lever formed by the arm 52. Consequently, the relative lengths of the driving arm and the arm of resistance of element 52 will be varied, thereby obtaining corresponding variations of the magnitude of the vibrations which are transmitted to the user, which vibration will always be generally controlled by the pace of pedalling.

Also, due to the telescopic adjustment between the arm 52 and the leg 54, the device can be employed by any user, since by raising or lowering the leg 54, the elastic band 57 can be placed with precise accuracy behind the lumbar region to which the user wishes to apply the vibrations. Likewise, due to rotation permitted by the adjustment elements 58, the band 57 can be positioned at any suitable angle, thereby achieving a comfortable use of the complete assembly.

We claim:

1. A gymnastic bicycle comprising:

a frame mountable on a floor and having front and rear portions;

a first stem supporting at a first end thereof a handlebar and having a second end pivotally mounted on said front portion of said frame for oscillating movement with respect thereto in forward and rearward directions;

a second stem supporting at a first end thereof a seat and having a second end fixed to said rear portion of said frame;

a pedal shaft having pedals and rotatably mounted transversely of said frame;

friction means, mounting said second end of said first stem on said front portion of said frame, for adjusting the resistance to the physical force of a user required to oscillate said first stem and said handlebar in said forward and rearward directions;

main vibrating means, including a polygonal member fixedly mounted on said pedal shaft, for, upon rotation of said shaft, imparting vibrations to said first stem and to said handlebar;

abdominal vibrating means, mounted on said handlebar, for transmitting said vibrations from said handlebar to the abdominal region of the user; and lumbar vibrating means, mounted on said second stem and operable by said main vibrating means independently of said abdominal vibrating means, for imparting vibrations to the lumbar region of the user.

2. A gymnastic bicycle as claimed in claim 1, wherein said friction means comprises a transversely extending axle fixed to said second end of said first stem, said axle having therethrough an axial opening including outwardly diverging truncated sections at opposite ends of said opening and defining conical friction surfaces of said axle, truncated bodies extending coaxially into respective said truncated sections of said axial opening, said bodies having conical surfaces complementary to said conical surfaces of said axle, means for connecting said bodies with said conical surfaces thereof directed toward friction contact with respective said conical surfaces of said axle, means for preventing rotation of said bodies about the axes thereof and with respect to said frame, whereby upon oscillation of said first stem and said axle in said forward and rearward directions said bodies form an axis of rotation for said oscillation and are prevented from rotating therewith, and means operatively associated with said connecting means for selectively adjusting the spacing between said bodies and thereby the frictional contact between said conical surfaces of said bodies and said axle, thus adjusting the resistance to said oscillating due to said frictional contact.

3. A gymnastic bicycle as claimed in claim 2, wherein said preventing means comprise circumferentially spaced grooves formed in the peripheries of said bodies, and a pair of parallel plates fixed to said frame at positions adjacent opposite ends of said axle, each said plate having therethrough an opening, each said body having a major base end extending through a respective said opening, and each said plate having integral tongues extending from the respective opening and fitting into said grooves of the respective said body.

4. A gymnastic bicycle as claimed in claim 2, wherein said connecting means comprises axial holes through said bodies, a bolt extending through said holes in said bodies, one said body having a widened recess opening into the respective said hole, said recess having a polygonal contour, and a nut threaded onto said bolt and fitted with said recess, said nut having a shape complementary to said polygonal contour of said recess, whereby rotation in opposite directions of said bolt within said holes of said bodies will cause axial movement of said bodies toward and away from each other.

5. A gymnastic bicycle as claimed in claim 4, wherein said selective adjusting means comprises a pinion fixed to said bolt within said axle and rotatable therein with said bolt, a ratchet extending through said axle and movable therewith during said oscillation, said ratchet having adjacent said pinion an inner end having a ratchet tooth biased toward said pinion and retractable away therefrom, and control means exterior of said axle for selectively adjusting said ratchet between a first position whereat said tooth catches on and rotates said pinion in a first direction upon said forward oscillation of said axle, a second position whereat said tooth catches on and rotates said pinion in a second direction upon said rearward oscillation of said axle, and a third position whereat said tooth does not catch on and rotate said pinion upon either forward or rearward oscillation of said axle.

6. A gymnastic bicycle as claimed in claim 2, wherein said main vibrating means comprises an integral projection extending from said axle and having therethrough a transverse hole, a pin extending through said hole, a connecting rod pivotally mounted at a first lateral side of a first end thereof to said pin, said connecting rod having at a second lateral side of said first end a concave curved surface having a radius of curvature equal to that of the outer surface of said axle, said connecting rod having a second end supporting a roller, means for biasing said connecting rod such that said roller is permanently in contact with said polygonal member, whereby rotation of said pedal shaft and said polygonal member imparts vibration to said roller and said connecting rod, and control means for selectively bringing said concave curved of said connecting rod into and out of contact with said outer surface of said axle, thereby selectively transmitting said vibrations to said axle, said first stem and said handlebar and interrupting such transmission.

7. A gymnastic bicycle as claimed in claim 6, wherein said control means comprises a bolt threadably connected to said frame and movable axially for abutment with said projection of said axle, such that axial movement of said bolt toward said projection causes said axle to pivot about said pin such that said outer surface of said axle moves out of contact with said concave curved surface of said connecting rod, thereby interrupting transmission of said vibrations from said connecting rod to said pin.

8. A gymnastic bicycle as claimed in claim 1, wherein said polygonal member comprises a portion formed by the deformation of a sprocket of the bicycle to form therein a polygonal recess.

9. A gymnastic bicycle as claimed in claim 1, wherein said abdominal vibrating means comprises a rod member having a forward end attached to said handlebar by a clamp, a fork integral with a second end of said rod member, said fork having a pair of spaced arms, a flexible band extending transversely between free ends of said arms and fixed thereto by respective tightening elements, and said rod member being formed by two tubes adjustably telescopically coupled together, such that said flexible band may be moved rearwardly toward the user or forwardly away from the user.

10. A gymnastic bicycle as claimed in claim 9, wherein said clamp has extending rearwardly therefrom an integral member, and further comprising a bolt threaded through said integral member into abutment with the top of said first stem, whereby the angle of inclination of said rod member with respect to said handlebar may be adjusted.

11. A gymnastic bicycle as claimed in claim 1, wherein said lumbar vibrating means comprises a rod hinged to said second stem, said rod having a lower end supporting a roller in contact with said polygonal member, a fork integral with and extending from an upper end of said rod, said fork having a pair of spaced arms, a flexible band extending transversely between free ends of said arms and fixed thereto by respective tightening elements, and said rod being formed by two tubes adjustably telescopically coupled together, such that the height of said flexible band may be adjusted.

12. A gymnastic bicycle as claimed in claim 11, wherein said rod is hinged to said second stem by a U-shaped member connected to said rod, said U-shaped member having therethrough vertically spaced holes, and a hinge pin adapted to extend through a selected said hole and supported by said second stem.

* * * * *